United States Patent [19]

Stoll

[11] Patent Number: 4,694,665

[45] Date of Patent: Sep. 22, 1987

[54] COUNTERFLOW WASHING MACHINE

[75] Inventor: Karl-Heinz Stoll, Wiesbaden, Fed. Rep. of Germany

[73] Assignee: Senkingwerk GmbH, Hildesheim, Fed. Rep. of Germany

[21] Appl. No.: 880,891

[22] Filed: Jul. 1, 1986

Related U.S. Application Data

[60] Continuation-in-part of Ser. No. 819,135, Jan. 15, 1986, Pat. No. 4,616,372, which is a division of Ser. No. 672,582, Nov. 16, 1984, Pat. No. 4,607,509.

[30] Foreign Application Priority Data

Nov. 17, 1983 [DE] Fed. Rep. of Germany ..... 3341504

[51] Int. Cl.[4] ..... D06F 31/00

[52] U.S. Cl. ..... 68/27

[58] Field of Search ..... 68/27, 58, 143, 145

[56] References Cited

U.S. PATENT DOCUMENTS 4,478,060 10/1984 Grunewald ..... 68/27

4,485,509 12/1984 Pellerin et al. ..... 68/27 X

FOREIGN PATENT DOCUMENTS 203345 10/1983 German Democratic Rep. .... 68/27

2066302 7/1981 United Kingdom ..... 68/27

*Primary Examiner*—Philip R. Coe

*Attorney, Agent, or Firm*—Karl F. Ross; Herbert Dubno

[57] ABSTRACT

When both colored and white wash are to be laundered together, one has the problem that pigment particles are transported from the colored pieces to the white pieces and the white pieces are discolored. This problem will be eliminated in a novel counterflow cycling washing machine by providing additional components besides the control components for the counterflow which produce a reversal of the usual counterflow to concurrent flow when a colored piece of wash is in the machine or the washing zone. For concurrent flow operation switchover of the valves permits the head of the washing liquid in the upstream compartment of the washing zone to cause the flow through this zone to the downstream compartment where the concurrent flow liquid is discharged.

5 Claims, 4 Drawing Figures

COUNTERFLOW WASHING MACHINE

CROSS REFERENCE TO RELATED APPLICATIONS

This application is a continuation-in-part of Ser. No. 819,135 filed Jan. 15, 1986, now U.S. Pat. No. 4,616,372, as a division of Ser. No. 672,582 filed Nov. 16, 1984, now U.S. Pat. No. 4,607,509.

FIELD OF THE INVENTION

My present invention relates to a counterflow washing machine and, more particularly, to a washing machine having a plurality of washing zones axially separated in a washing drum and each of which is provided with a plurality of compartments.

BACKGROUND OF THE INVENTION

Continuous washing paths established by a washing drum and through which the items are laundered are passed substantially continuously by rotational transfer through drum rotation or by operation of a screw are of course known. The rotary drum type machines are evident from the references contained in the above-identified application and the construction of machines using worms will be apparent from the commonly owned U.S. Pat. Nos. 4,422,309 and 4,494,265 and the documents of record in the files thereof.

Generally these items are passed through the washing machine in a direction opposite to the flow of washing or running liquid and especially in the washing process to conserve water and energy.

A single counterflow cycle washing machine drum often may be divided into an initial soaking zone having two or more compartments, an outer washing zone which can have a comparatively large number of compartments and a rinsing zone which can have fewer compartments than the washing zone.

The items to be washed are fed to a loading chamber and thereafter are transferred in discrete batches from one chamber to another through the individual zones according to a cyclic process.

In the system described in the aforementioned applications, the drum may angularly oscillate about its axis to a certain extent to agitate each batch in the respective chamber in a corresponding treatment liquid and in accordance with the desired washing cycle. Then a further rotation of the drum can automatically transfer the batches in a direction of movement into the next compartment.

Toward the end of the wash drum or trommel which is relatively downstream in the direction of movement of the wash, fresh water can be supplied to at least partially flow through the washing trommel in counterflow to the laundered articles. These processes are problem-free as long as only white articles of laundry are washed in the apparatus.

In recent years the proportion of colored articles, for example, green or blue laundry, colored bedding, table clothes or napkins, is relatively large and is expected to grow.

However, when brightly colored and white articles are laundered together in a conventional cyclic washing unit, problems are encountered because colored particles can be entrained from colored fabrics to the white fabrics and can discolor them.

To avoid such discoloration of the white wash, colored material has either been washed in a separate machine or in a bath-change washing stretch which does not work in counterflow, thereby eliminating the possibility of entrainment of such particles onto upstream white wash from comparatively downstream colored laundry.

This means higher invention costs since a bath-change washing stretch is considerably more expensive than a counterflow washing machine and this means higher washing costs. The operational costs are likewise higher. One can avoid or limit transfer of coloring from pigmented articles to white wash in a counterflow washing machine by leaving the bulk of the washing chambers empty. In practice this has meant that 60 to 70% of the washing chambers or compartments will remain empty when strongly colored materials are washed. Naturally this reduces the performance of the machine considerably because water, steam and washing liquors must be supplied in the same amounts even when there is no wash in some of the chambers.

In order to eliminate these empty chambers and the difficulties involved in their use, the liquid counterflow can be bypassed around the wash chamber in which a colored batch of laundry may be present. This maintains counterflow elsewhere but eliminates the counterflow for chambers containing problematical wash. An expensive and cumbersome control apparatus is required for this system.

OBJECTS OF THE INVENTION

The principal object of this invention is to provide a counterflow washing machine of the cycling type which extends the principles set forth in the above identified applications.

Another object of this invention is to provide an improved continuous or flowthrough washing machine which is able to wash both colored and white laundry together simultaneously without the need for leaving empty washing chambers between them.

A further object of this invention is to provide an improved counterflow cycling washing machine which will wash colored and white laundry together without load spacing and in a more economical and simple manner than prior art counterflow washing machines.

SUMMARY OF THE INVENTION

These objects and others which will become apparent hereinafter are attained, in accordance with the invention, essentially with a washing machine which comprises:

a washing drum axially subdivided into a plurality of washing zones, each divided into a plurality of washing compartments, the drum being provided with means for transferring batches of wash through the zones and the compartments in one direction and in succession, and for agitating the batches in the compartments;

first flow-control means communicating with the drum for introducing a first washing liquid to a relatively upstream compartment of at least one of the zones and for draining the first washing liquid from the drum at a relatively downstream compartment of the one of the zones, whereby the first washing liquid flows from the relatively upstream compartment to the relatively downstream compartment in the direction and contacts the batches in the relatively upstream compartment the relatively downstream compartment and compartments of the one of the zones between the relatively upstream compartment and the relatively downstream compartment;

second flow-control means communicating with the drum for introducing a second washing liquid to the relatively downstream compartment of the one of the zones and for draining the second washing liquid from the drum at the relatively upstream compartment of the one of the zones, whereby the second washing liquid flows from the relatively downstream compartment to the relatively upstream compartment in counterflow to the direction and contacts the batches in the relatively upstream compartment, the relatively downstream compartment and compartments of the one of the zones between the relatively upstream compartment and the relatively downstream compartment; and means for contacting the batches with other liquids in others of the zones and the compartments.

Advantageously, the means for transferring batches of wash through the zones is a worm rotatable in the drum, a flight of the worm axially subdividing the interior of the drum into the compartments.

Preferably the aforementioned one zone is an intermediate zone along the length of the drum.

While transfer of the washing liquid in the washing zone can be effected as described in the aforementioned copending applications by pump arrangements which may also be used here, I prefer to use gravity. Accordingly, the first flow-control means includes valve means for introducing the first washing liquid to the relatively upstream compartment to a level exceeding a level of the first washing liquid in the relatively downstream compartment so that the first washing liquid flows by gravity in a downstream direction corresponding to the direction in which the batches are displaced by the worm.

The second flow-control means includes valve means for introducing the second washing liquid to the relatively downstream compartment to a level exceeding a level of the second washing liquid in the relatively upstream compartment so that the second washing liquid flows by gravity in an upstream direction counter to the direction in which the batches are displaced by the worm.

A method aspect of the invention can be considered a method of operating a counterflow cyclic washing machine as described wherein, upon entry of colored laundry into the washing zone and during the presence of the colored laundry in this zone, the counterflow pumps which displace the washing liquid from chamber to chamber are cut off and the washing liquid is switched to feed from an inlet at an upstream compartment of the zone occupied by the colored laundry and to discharge from a downstream compartment of that zone.

The above-mentioned problems of the prior art washing machines are thus solved by reversing the washing machine or individual washing zones from counterflow to concurrent flow (i.e. bath flow is reversed so that it is opposite to that of counterflow and in the direction of movement of laundered articles) as long as a piece of pigmented wash is found in the machine or washing zone.

The bath flow reversal is accomplished by an additional flow control means for any or all the washing zones of a counterflow cycling washing machine.

These additional flow control means comprise an outlet valve for the counter flow discharge outlet, if it has not been provided in the usual machine design, and an additional wash fluid input pipe and input valve near the discharge outlet for counterflow liquid and an additional wash fluid discharge outlet and discharge valve near the inlet for the wash fluid during counterflow.

One has in this way the advantages of a counterflow cycling washing machine combined with a kind of multiliquor washing machine which works more by a steeping or soaking process so that without further change, the machine can be operated as one or the other.

BRIEF DESCRIPTION OF THE DRAWING

The above and other objects, features and advantages of the present invention will become more readily apparent from the following description, reference being made to the accompanying drawing in which.

FIG: 1 is a flow diagram of a washing machine in accordance with this invention and illustrating principles described and claimed in the aforementioned applications, showing the control components and piping functioning during counterflow operation;

SPECIFIC DESCRIPTION

Figure 1:
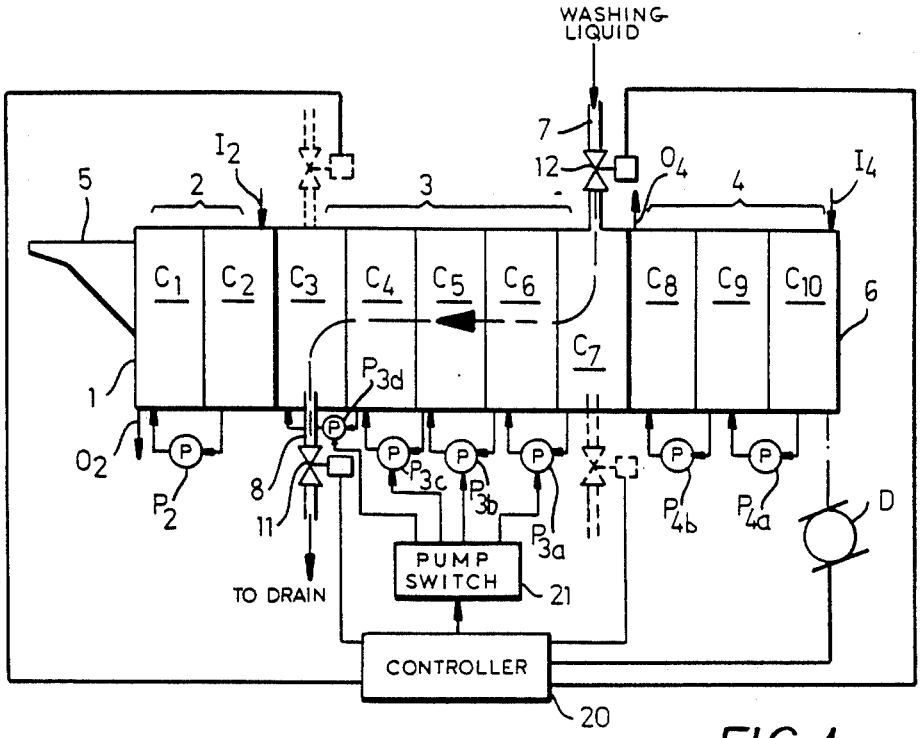

A washing trommel 1 divided into individual chambers ($C_1$–$C_{10}$) grouped into a soaking/prewashing zone 2 ($C_1$,$C_2$), a main washing zone 3 ($C_3$–$C_7$), and a rinsing zone 4 ($C_8$–$C_{10}$), is rotatable about its longitudinal axis by a drive D, whereby the wash is advanced through the machine in a known way from the upstream entrance 5 compartment by compartment and is fed into a water extraction press after discharge from its downstream end 6. In each compartment the laundry is agitated for a predetermined period set by the controller 20 before the laundry is transferred to the next compartment.

Customarily the wash fluid will be fed in counterflow to the transport of the wash materials, that is in the direction opposite to the direction of flow of the pieces to be washed as shown in FIG. 1 for the pure washing zone 3. The wash fluid is fed into the downstream end of the pure washing zone 3 through input pipe 7 having an electromagnetic input valve 12 and drained from a discharge outlet 8 having an electromagnetic outlet valve !1 at the upstream end of the pure wash zone 3, where "downstream" and "upstream" refers to the direction of transport of the wash.

Figure 2:
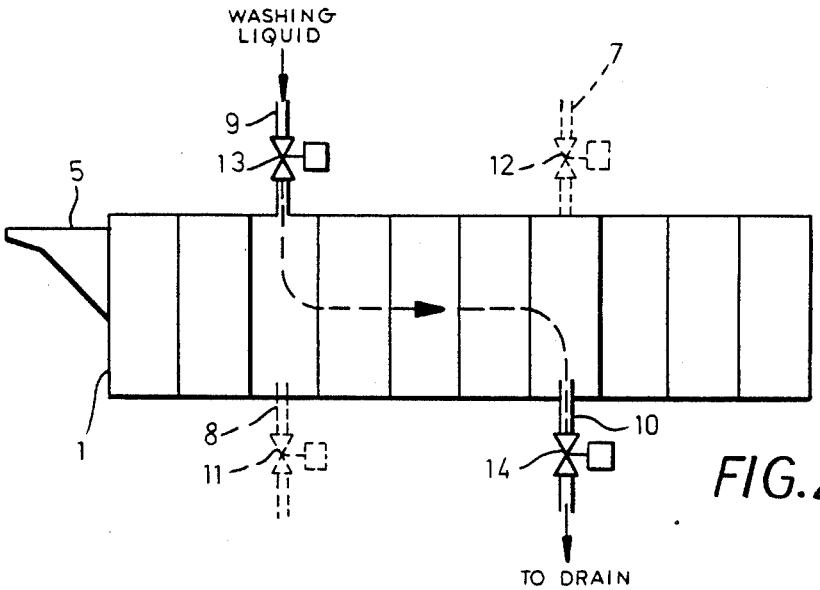
FIG. 2 is a diagram of the machine of FIG. 1 during concurrent flow operation.

So that the wash fluid can as needed be also fed concurrently with the flow of wash, additional wash fluid input pipe 9 and electromagnetic input valve 13 are provided at the upstream end of the main washing zone 3 and an additional discharge outlet 10 and outlet electromagnetic valve 14 are provided at the downstream end of the main wash zone 3 so that during concurrent flow the wash fluid flow is as shown according to the arrows in FIG. 2. Therefore to provide concurrent flow instead of counterflow discharge, outlet valve 11 and input valve 12 are closed as input valve 13 and discharge output valve 14 are opened and the wash fluid pump is shut off.

The invention has been described as applied to the pure washing zone 3 in the above embodiment but is also applicable to the other washing zones or to the entire machine.

The controller 20, therefore, in addition to timing the operation of the counterflow pumps $P_{4a}$,$P_{4b}$ of the rinsing zone and the pump $P_2$ of the soaking/prewash zone 2 can operate a switch 21 for cutting off the counterflow pumps $P_{3a}$–$P_{3d}$ between the compartments $C_7$, $C_6$, $C_5$, $C_4$ and $C_3$ of the washing zone simultaneously with closure of valves 11 and 12 and opening of valves 13 and 14. The transfer of liquid from compartment to compartment in the washing zone is here effected by the drum with transfer of the laundry.

Figure 3:
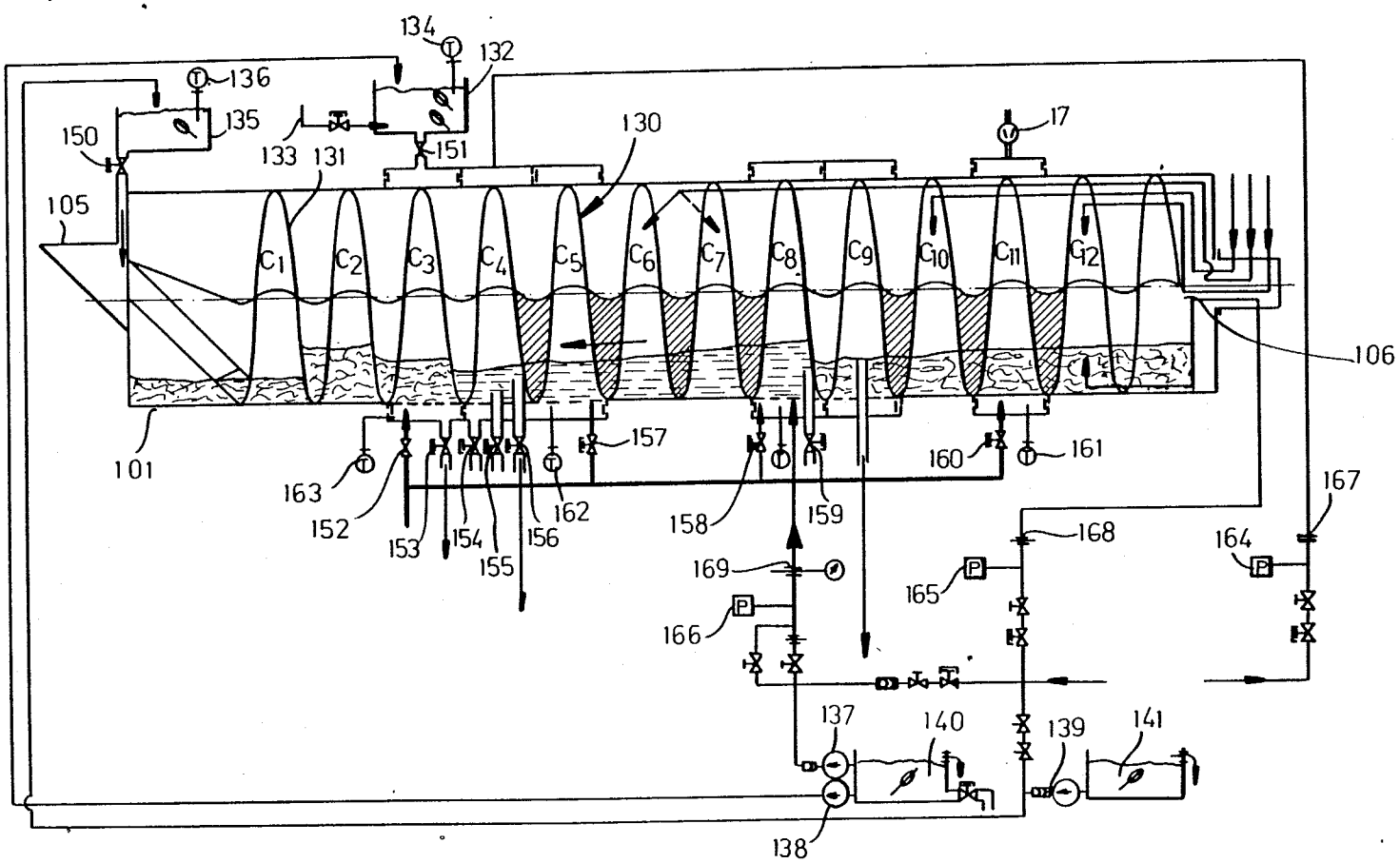
FIG. 3 is a diagram of another type of continuous washer showing the conditions during counterflow.
Figure 4:
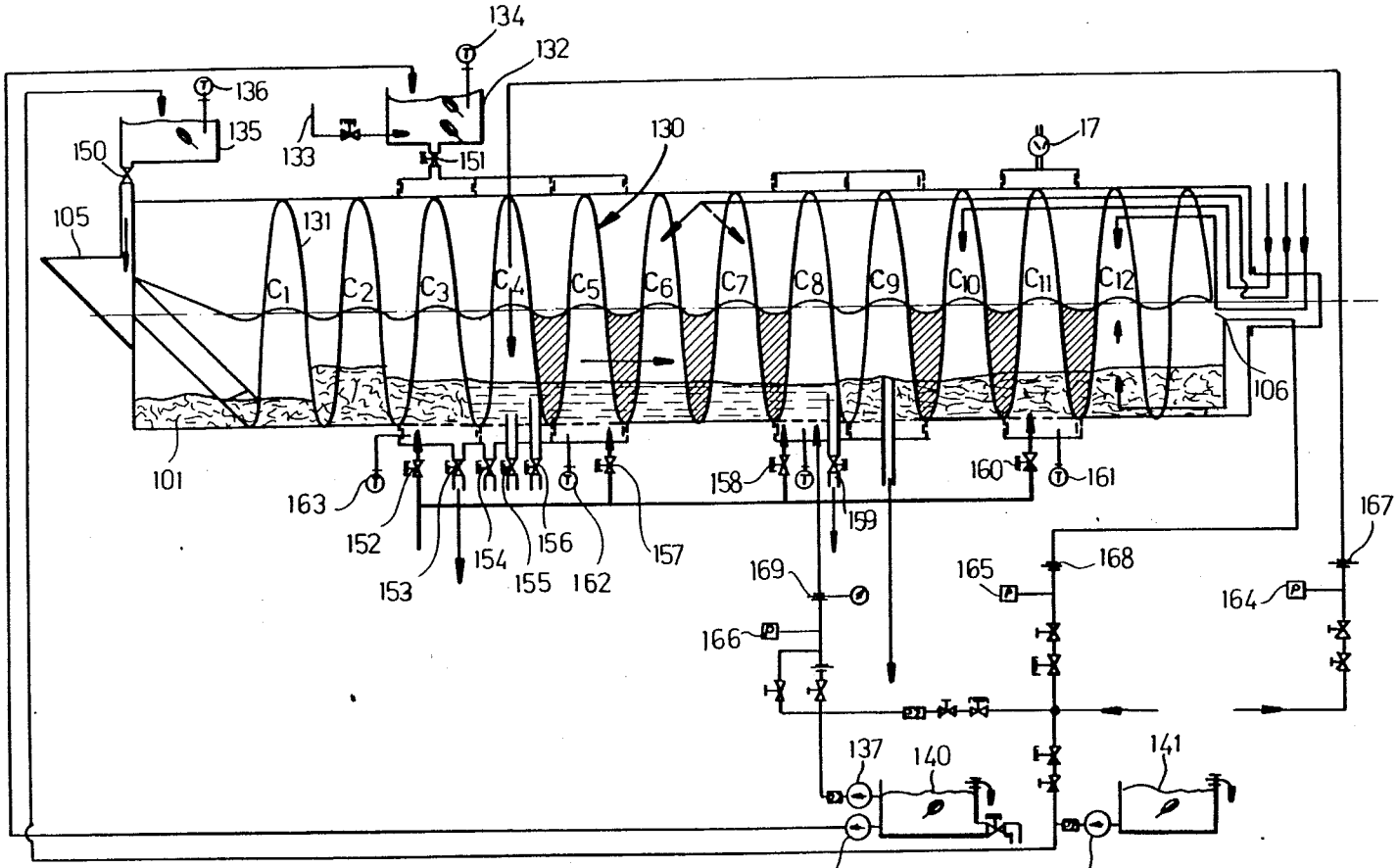
FIG. 4 is a diagram of this latter machine showing the conditions during concurrent flow operation.

As can be seen from FIGS. 3 and 4, the drum 101 having an inlet 105 and an outlet 106 for the laundry can be rotated and can be provided with a worm 130 whose helical flight 131 subdivides the interior of the drum into compartments $C_1$–$C_{12}$.

The compartments $C_1$ and $C_2$ can form a soaking zone and the compartments $C_3$–$C_8$ can form a washing zone.

The washing zone is followed by a rinsing zone consisting of compartments $C_9$–$C_{12}$.

While much of the structure used in this system is not essential for the purposes of the present description, it should be noted that the washing machine generally will comprise a vessel 132 containing a washing liquor which can be heated by steam from a pipeline 133, the temperature of the washing liquor tank being measured by a gauge 134. Similarly the soaking liquor can be held in a tank 135 whose temperature is indicated at 136. Recirculation of the washing liquors and the displacement of fresh washing and rinsing liquids is effected by means of pumps 137, 138 and 139 and the various liquids may be prepared or collected in tanks 140, 141.

The flow of the various fluids is controlled by valves 150–160, other valves being provided as bypasses to permit mixing of fluids as may be required. Other temperature measurements can be obtained from gauges 161, 162, 163 and to regulate the flows, pressure gauges 164, 165, 166 and flow meters 167, 168 and 169 can be provided.

A fan 170 can be provided at the downstream end of the washing machine.

The washing machine shown in FIGS. 3 and 4 can be used generally in a conventional manner and hence its operation will not be described in any detail. However as for the embodiments of FIGS. 1 and 2, the counterflow operation normally prevails (FIG. 3). In this case, washing liquid is drained through the valve 156 or, if desired, through the valves 154, 155, while the washing liquid is added as represented by heavy lines at an upstream end of the washing zone through valves 158, for example, and even through a valve 157.

The flow is so controlled that the natural head of liquid as shown by the shading in FIG. 3, will cause the liquid to flow in an upstream direction with respect to laundry movement. The flow through the rinsing and soaking zones is correspondingly a counterflow.

However, when there is danger that colored particles may be transferred to white laundry, a concurrent flow is used with switchover as has previously been described and in that case the liquid is introduced into the compartment 4 and flows to compartment 8 where it is drained via the valve 159. Here again the concurrent flow need prevail only in the washing zone. Automatic switchover can be effected in the manner described and it will be noted that in this embodiment the transfer of liquid between compartments does not require individual pumps.

I claim:

1. A washing machine, comprising:

a washing drum axially subdivided into a plurality of washing zones, each divided into a plurality of washing compartments, said drum being provided with means for transferring batches of wash through said zones and said compartments in one direction and in succession, and for agitating said batches in said compartments;

first flow-control means communicating with said drum for introducing a first washing liquid to a relatively upstream compartment of at least one of said zones and for draining said first washing liquid from said drum at a relatively downstream compartment of said one of said zones, whereby said first washing liquid flows from said relatively upstream compartment to said relatively downstream compartment in said direction and contacts said batches in said relatively upstream compartment, said relatively downstream compartment and compartments of said one of said zones between said relatively upstream compartment and said relatively downstream compartment;

second flow-control means communicating with said drum for introducing a second washing liquid to said relatively downstream compartment of said one of said zones and for draining said second washing liquid from said drum at said relatively upstream compartment of said one of said zones, whereby said second washing liquid flows from said relatively downstream compartment to said relatively upstream compartment in counterflow to said direction and contacts said batches in said relatively upstream compartment, said relatively downstream compartment and compartments of said one of said zones between said relatively upstream compartment and said relatively downstream compartment; and means for contacting said batches with other liquids in others of said zones and said compartments.

2. The washing machine defined in claim 1 wherein said means for transferring batches of wash through said zones is a worm rotatable in said drum, a flight of said worm axially subdividing the interior of said drum into said compartments.

3. The washing machine defined in claim 2 wherein said one of said zones is an intermediate zone along the length of said drum.

4. The washing machine defined in claim 3 wherein said first flow-control means includes valve means for introducing said first washing liquid to said relatively upstream compartment to a level exceeding a level of said first washing liquid in said relatively downstream compartment so that said first washing liquid flows by gravity in a downstream direction corresponding to the direction in which said batches are displaced by said worm.

5. The washing machine defined in claim 3 wherein said second flow-control means includes valve means for introducing said second washing liquid to said relatively downstream compartment to a level exceeding a level of said second washing liquid in said relatively upstream compartment so that said second washing liquid flows by gravity in an upstream direction counter to the direction in which said batches are displaced by said worm.

* * * * *